United States Patent [19]

Lydon

[11] 4,206,740

[45] Jun. 10, 1980

[54] CROSS BOW PISTOL

[76] Inventor: Edward B. Lydon, 22 Garnet Rd., Nichols, Conn. 06611

[21] Appl. No.: 957,190

[22] Filed: Nov. 2, 1978

[51] Int. Cl.[2] ..... F41B 5/00

[52] U.S. Cl. ..... 124/25; 124/40; 124/35 R

[58] Field of Search ..... 124/25, 35 R, 35 A, 124/41 A, 24 R, 23 R, 40, 41 R, 18, 19

[56] References Cited

U.S. PATENT DOCUMENTS

| | | | |
|---|---|---|---|
| 2,741,238 | 4/1956 | Arnold | 124/19 |
| 2,786,461 | 3/1957 | Pelsue | 124/25 |
| 3,028,851 | 4/1962 | Drake | 124/25 X |
| 3,406,676 | 10/1968 | Dye | 124/41 A |

*Primary Examiner*—William R. Browne

*Attorney, Agent, or Firm*—St. Onge, Steward, Johnston, Reens and Noë

[57] ABSTRACT

A cross bow pistol is disclosed having a release mechanism comprising a wheel having pairs of notches spaced equidistantly around its periphery. One of each pair of notches is adapted to receive the bow string and its associated notch is adapted to receive a trigger sear. Each sear notch also is engaged by a safety hook adjacent the bow string notch at the top of the release wheel. There is also disclosed an arrow holder of resilient deformable material at the front end of the cross bow which has a central opening for holding the front end of an arrow in position for firing. The arrow holder is split into two portions to permit the arrow vanes to pass through the holder. There is also disclosed a vertically adjustable rear sight and a slot and screw holding configuration for the bow.

10 Claims, 7 Drawing Figures

Fig. 1.
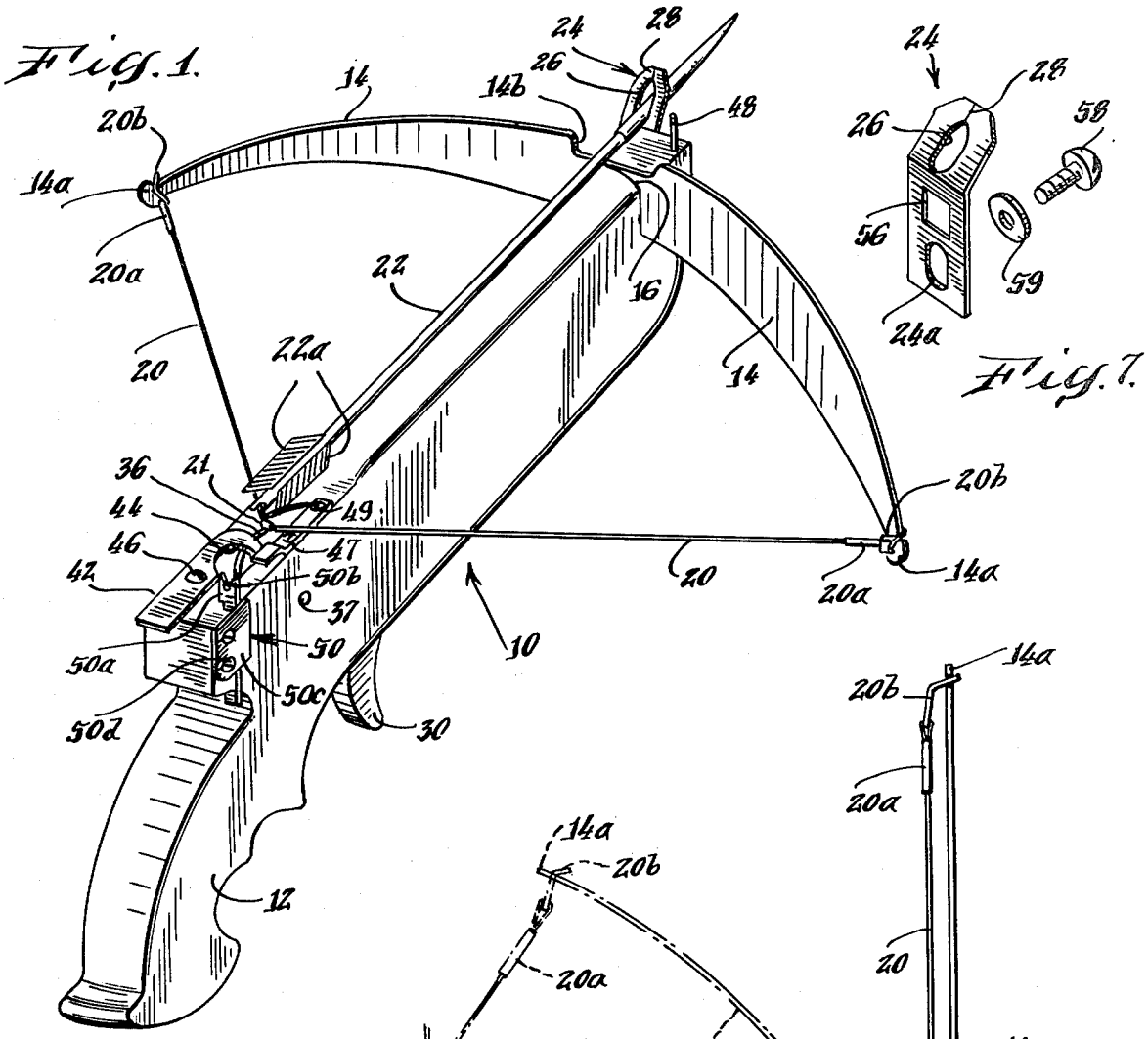
Fig. 7.
Fig. 2.
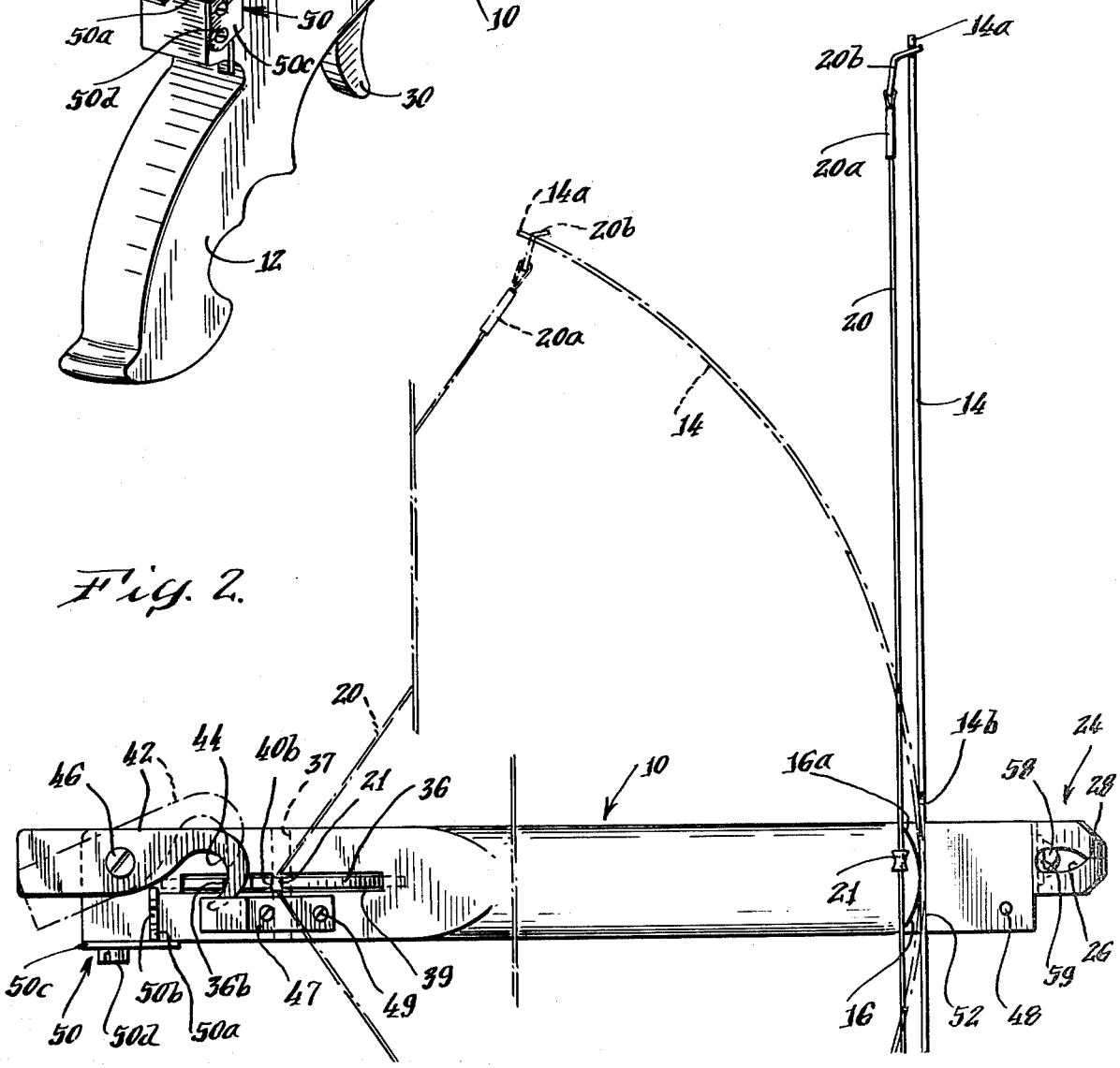

CROSS BOW PISTOL

BACKGROUND OF THE INVENTION

1. Field of the Invention

The present invention relates to a cross bow and more particularly to a cross bow pistol capable of being held and fired with one hand and having a release and safety mechanism, a deformable arrow holder, and other features.

2. Description of the Prior Art

Cross bows in general are centuries old and generally have been made in the form of a shoulder-held or rifle-like weapon such as those shown in U.S. Pat. Nos. 2,500,509; 3,788,299 and 3,483,857. Cross bow pistols are also generally known as shown in U.S. Pat. No. 2,786,461.

Cross bows are generally used today for hunting, fishing, or target shooting. Cross bows are dangerous weapons which fire arrows which can injure or maim persons or animals and accordingly, it is desirable that the cross bow release mechanism be safe and reliable while still being reasonable in cost. Other prior art release mechanisms have safety catches which are not clearly visible. Prior art release mechanisms are shown in U.S. Pat. Nos. 3,490,429 and 4,030,473.

Further problems in prior art cross bows are encountered in the holding of the arrow on the cross bow prior to firing. Elaborate devices such as those shown in U.S. Pat. No. 3,788,299 have been made in an attempt to solve the problem of the arrow being dislodged or misaligned from the cross bow when it is tipped. Such mechanisms however have been unduly cumbersome, prone to breakdown and in some cases are to costly.

Still further prior art problems relate to the providing of a cross bow, particularly a cross bow pistol, having an inexpensive adjustable sighting system and one which is capable of being quickly and easily broken down for storage or shipping.

SUMMARY OF THE INVENTION

The present invention provides a cross bow pistol having a simplified trigger release and safety system and a deformable arrow holder and a guide at the front of the cross bow. Other novel features relate to the adjustable sighting system and the method of securing the bow to the pistol's frame for rapid assembly and disassembly.

The trigger release and safety mechanism comprises a wheel having three pairs of notches positioned 120° from one another. The forward most notch of each pair holds the cross bow string while a sear notch immediately to the rear of the string notch is engaged by a pivotable safety hook for preventing accidental firing of the cross bow. The release wheel is held by engagement of the trigger sear with the sear notch located 120° from the sear notch at the top of the wheel. Each sear notch 120° around the periphery of the release wheel thus may serve as the trigger engaging notch in the interior of the cross bow stock and may also serve to engage the safety hook at the top of the stock. The release wheel may have two or more pairs of notches with three pairs being preferred.

The arrow holder and guide located at the front of the cross bow is made of deformable material such as plastic and has a central opening for receiving the arrow tip holding an arrow securely at rest. The holder is adjustable both horizontally and vertically to act as an adjustable guide. The holder has a split top portion and when the arrow is fired, the feathers or guide vanes of the arrow deform the arrow guide to permit the vanes to pass through. The cross bow of the invention can be readily dismantled by the removal of a single screw and is provided with a vertically adjustable rear sight.

OBJECTS OF THE INVENTION

One object of the present invention is to provide a cross bow release mechanism which is reliable in operation and economical in construction.

Another object of the invention is to provide a cross bow release mechanism of the above character which has a reliable and visible safety mechanism.

Another object of the invention is to provide a cross bow of the above character wherein there is provided an adjustable deformable arrow holder for an arrow in position on the cross bow prior to firing, and which deforms as the arrow vanes pass through the holder.

Still another object of the invention is to provide a cross bow of the above character which can be readily dismantled and which has adjustable sights.

Other objects of the invention will in part be obvious and will in part appear hereinafter. The invention accordingly comprises the features of construction, combination and arrangement of parts which will be exemplified in the constructions hereinafter set forth, and the scope of the invention will be indicated in the claims.

BRIEF DESCRIPTION OF THE DRAWINGS

FIG. 1 is a rear perspective view in reduced scale of the cross bow of my invention;

FIG. 2 is a top partial view of the cross bow of my invention with the bow and bow string shown in phantom lines when cocked;

FIG. 7 is an exploded perspective view of the arrow holder assembly.

DESCRIPTION OF THE PREFERRED EMBODIMENT

Figures 3, 4, 5, 6:
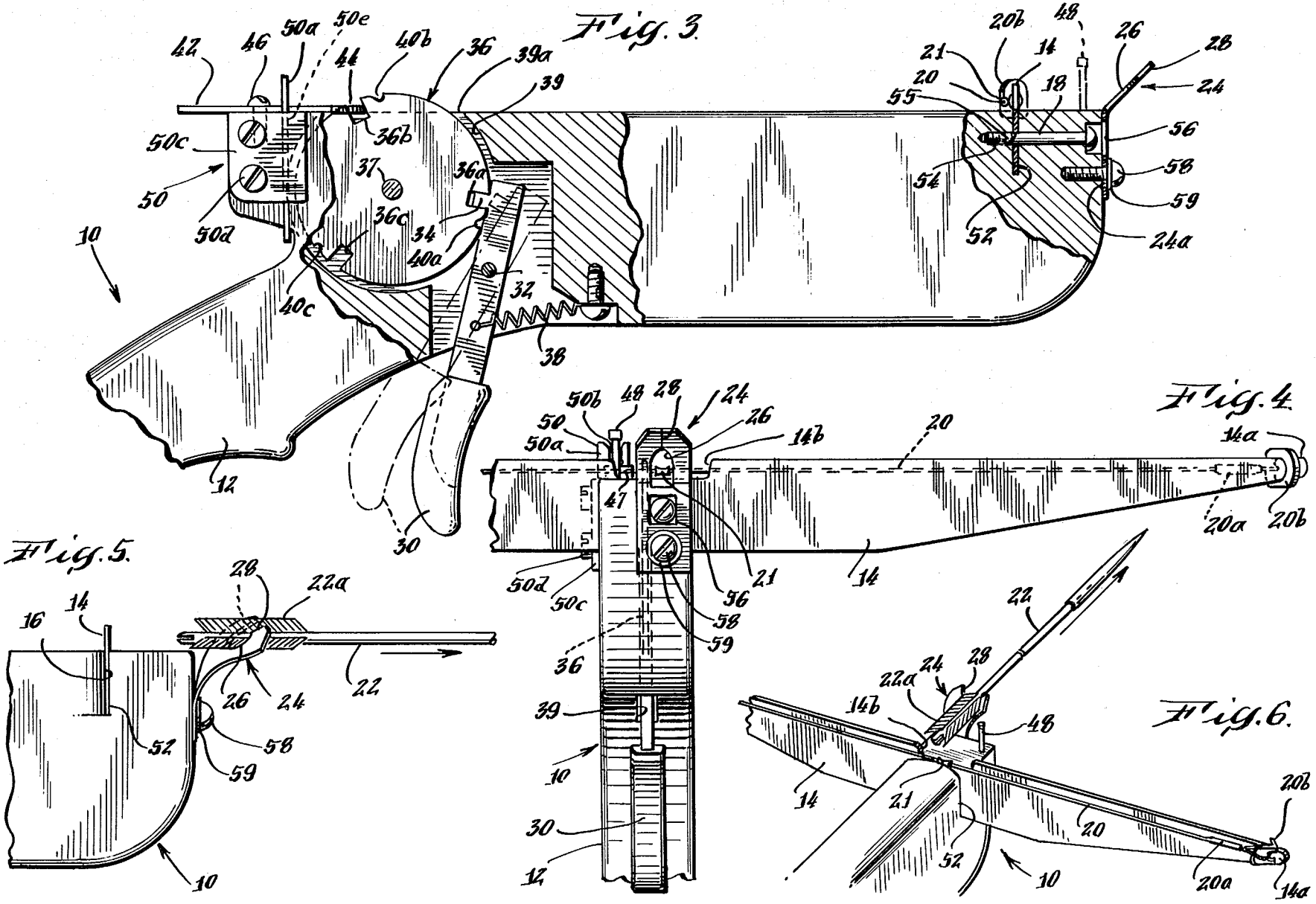
FIG. 3 is a partial side view of the cross bow of my invention in partial section showing the trigger in phantom lines in its arrow release position.
FIG. 4 is a front partial view of the cross bow of my invention.
FIG. 5 is a partial view of the front portion of the cross bow of my invention showing the deformable arrow holder as an arrow passes therethrough.
FIG. 6 is a top perspective view of the front portion of the cross bow of my invention showing an arrow passing through the deformable arrow holder.

As best seen in FIGS. 1 and 2, the cross bow of my invention has a stock 10 having a pistol grip 12 with a bow 14 which is preferably of spring steel or of laminated fiberglass or wood. The bow 14 is held in a curved slot 16 by the removable pin 18, as will be more fully explained hereinafter. The bow string 20 is preferably of twisted steel wire secured by crimped sleeves **20*a* to loops 20*b* which pivot on bow ends 14*a***.

As best seen in FIG. 1, the arrow 22 is held at its front end in arrow holder 24 which has a central opening 26 for receiving the arrow and a split 28 at its top. The arrow guide is made of a resilient deformable material such as thin polyethylene or the like so that when the arrow vanes **22*a* pass through the arrow guide the split 28 separates and the side portions will deform to permit the vanes to pass through without injuring the vanes or putting the arrow off course. The split should be adjacent the top of the holder to permit the two sides to deform as the arrow vanes pass through the opening 26**.

Referring now to FIGS. 2 and 3, it will be seen that the trigger mechanism comprises a trigger 30 which is pivoted at pin 32 and has a sear 34 which is urged into one of notches 36*a, b* or *c* on release wheel 36. Sear 34 is urged into engagement with one of these notches by spring 38 secured to the trigger and the stock. Release wheel 36 also is provided with notches 40*a, b* and *c* which are just forward of the notches 36*a, b* or *c* as seen in FIG. 3. The release wheel rotates about pin 37 in a slot 39 formed in the stock. Slot 39 is open at its top 39*a* so that the top of wheel 36 protrudes to expose its top notches. The notches 40*a, b, c,* when at the top of release wheel 36, as shown in FIG. 3, engage the bow string 20 which may be provided with a reinforced metal sleeve 21 for engaging the release wheel.

The safety catch 42 has a hook portion 44 for engaging one of the notches 36*a, b* or *c* on the top of the release wheel 36 as it is pivoted about a screw 46 secured to the stock. A retention plate 47 held by screws 49 is provided to engage the end of hook 44 to hold it more securely in one of the notches 36*a, b* or *c*.

Each notch 36*a, b* or *c* are 120° apart around the periphery of the release wheel 36 and similarly, string notches 40*a, b* and *c* are 120° apart around the periphery of the release wheel. The notches 36*a, b* and *c* are formed in a squared configuration to closely fit with sear 34 while notches 40*a, b* and *c* are smaller and as seen in FIG. 3, each notch 40*a, b* and *c* has an inclined rear surface which cannot engage the sear 34 against rotation of release wheel 36 in a clockwise direction as seen in FIG. 3. Thus, only the notches 36*a, b* and *c* are adapted to engage the sear 34 which will always position one of the notches 40*a, b* or *c* at its top bow string receiving position as shown in FIG. 3.

There is also provided a front fixed sight 48 and a rear adjustable sight assembly 50 comprising a vertically movable member 50*a* having a notch 50*b* at its top. The moveable member 50*a* is held in a slot in the stock by plate 50*c* secured by screws 50*d*. Thus the rear sight 50*a* may be raised or lowered by sliding it up or down in slot 50*e* and the sight will be frictionally held in position by the spring action of plate 50*c*.

As best seen in FIGS. 3 and 4, bow 14 has a central notch 14*b* for accommodating the arrow and the bow is held in the stock in a groove 52 by a screw 54 which is accessible through opening 56 of arrow guide 24. The bow 14 has a centrally located hole 55 below cutout portion 14*b* for receiving screw 54. To remove the bow from the stock merely requires removal of screw 54 and the bow can be lifted from the slot 16 in the top of the stock. Slot 16 has a curved rear surface 16*a* (FIG. 2) to permit flexing of the bow in the stock area.

Arrow holder 24 is held in position by a screw 58 and washer 59 on the front of the stock portion. The holder has an elongated slot 24*a* for receiving screw 58 so that the holder 24 may be raised or lowered and moved slightly to one side or the other to improve the accuracy of the cross bow.

To operate the cross bow of my invention, the release wheel 36 is turned so that a pair of notches are positioned on top of the stock portion and at that point sear 34 will engage one of the sear notches 36*a, b* or *c* to hold the wheel in a locked position. The hook 44 of safety 42 is pivoted into the sear notch on top of the release wheel and the bow string 20 is then pulled back and hooked into the top forward notch (40*a, b* or *c*) just forward of its associated sear notch (36*a, b* or *c*). An arrow is then positioned with its forward end just through arrow holder 24 with the arrow nock 22*b* engaging the bow string alongside the release wheel 36 (FIG. 2). The cross bow is now ready for firing.

To fire the cross bow the safety 42 is pivoted out of sear notch 36 in counterclockwise direction as seen in FIG. 2 and the arrow is released by pulling the trigger to remove sear 34 from its associated notch in the release wheel. The wheel 36 is free to rotate under the tension of the bow string and the arrow is then fired from the cross bow.

As shown in FIGS. 5 and 6, the arrow passes through the arrow holder 24 and the flexible nature of the arrow holder material and the split 28 permit the arrow vanes or feathers to pass through the arrow holder without injury to the vanes and without altering the arrows's course.

It will thus be seen that the objects set forth above among those made apparent from the preceding description are efficiently attained and since some changes may be made in my cross bow without departing from the scope of the invention, it is intended that all matter contained in the above description and shown in the accompanying drawings shall be interpreted as illustrative and not in a limiting sense.

What is claimed is:

1. A release mechanism for a cross bow having a stock, bow and bow string, and further comprising:

A. a release wheel pivotably secured in the stock with the wheel plane in the direction of arrow flight,
   1. said wheel having a plurality of pairs of notches positioned successively around the periphery of the wheel, and
      a. the forward most notch of each pair being a bow string notch adapted to receive the bow string,
      b. and the rearward notch of each pair being a sear notch adapted to engage a trigger sear;

B. a trigger pivotably mounted with one end biased toward said release wheel,
   a. and having a sear positioned on the end biased toward said release wheel,
   b. said trigger and sear being adapted to engage only the sear notch of a notch pair inside said stock; and C. a pivotable safety for preventing the wheel from rotating when in a cocked position, said means having a means or engaging and disengaging one of said sear notches at a position near the top of the stock.

2. The release mechanism for a cross bow as defined in claim 1 wherein said release wheel has three pairs of notches equidistantly spaced around the periphery of said release wheel.

3. The release mechanism for a cross bow as defined in claim 1 wherein said safety mechanism comprises a pivotable hook adapted to engage the sear notch of a pair of notches adjacent the bow string notch.

4. The release mechanism for a cross bow as defined in claim 1 wherein there is provided an arrow holder secured to the front of the stock, said arrow holder being made of an easily deformable but resilient material and having an opening therein for temporarily holding the front end of a notched arrow and further having a split in said holder for permitting passage of arrow vanes therethrough.

5. A cross bow having a stock, a bow and a bow string and further comprising:

A. a release wheel pivotably secured in the stock with a top portion of said wheel out of said stock, 1. said release wheel having a plurality of adjacent pairs of notches positioned equidistantly around the wheel periphery, a. the plane of said wheel being positioned in the direction of arrow flight, b. the forward most notch of each pair being the bow string notch adapted to hold the bow string prior to release and c. the rearward notch of each pair being the sear notch and adapted to engage a trigger sear;

B. a trigger member pivotably mounted in the stock and biased at one end toward said release wheel, 1. a sear extending from the end of said trigger biased toward said release wheel, a. said sear being positioned with respect to said release wheel to releasably engage one of said sear notches when a bow notch is on the top of said wheel out of the stock;

C. a safety mechanism having means for engaging one of said sear notches spaced from the one engaged by said sear;

D. an arrow holder adjacent the top front portion of said stock, 1. said arrow guide holder of a resilient, deformable material, a. and having means forming an opening therein for holding the forward end of an arrow and b. means forming a split adjacent the top of said arrow holder to permit each side of the arrow guide to freely deform as arrow vanes pass therethrough.

6. A cross bow having a stock, a bow and a bow string as defined in claim 5 wherein said release wheel has three pairs of notches, each forward bow string notch having a sloped rearward surface to prevent engagement of said sear with a bow string notch.

7. A cross bow having a stock, a bow and a bow string as defined in claim 5 wherein said safety mechanism comprises a pivotable hook on the top of the stock and adjacent said wheel, said hook being engageable with the sear notch positioned on the top of the stock.

8. A cross bow having a stock, a bow and a bow string as defined in claim 5 wherein said arrow guide is made of a plastic material and is secured to the front of the stock.

9. A cross bow having a stock, a bow and a bow string as defined in claim 5 wherein said arrow holder is angled forwardly and said means forming said opening in said arrow guide is elongated from top to bottom terminating in said split at its top.

10. The cross bow defined in claim 5 wherein said arrow guide holder is secured to said stock through an elongated slot, to provide vertical and horizontal adjustment of said holder with respect to said stock.

* * * * *